US005937864A

United States Patent [19]

Diaz

[11] Patent Number: 5,937,864

[45] Date of Patent: Aug. 17, 1999

[54] HAIR COLORING APPLICATOR WITH MIXING CHAMBER

[76] Inventor: Donne'J. Diaz, 100 NE. 61 Ter., Gladstone, Mo. 64118

[21] Appl. No.: 09/160,162

[22] Filed: Sep. 25, 1998

[51] Int. Cl.[6] ..... A45D 24/22; A46B 11/00; B43K 5/02

[52] U.S. Cl. ..... 132/112; 132/114; 401/4; 401/40

[58] Field of Search ..... 132/112, 114, 132/120, 73, 73.5, 74.5, 75; 401/4, 40

[56] References Cited

U.S. PATENT DOCUMENTS

| | | | |
|---|---|---|---|
| 1,393,903 | 10/1921 | Perez et al. | 401/40 |
| 1,450,398 | 4/1923 | Winter | 401/40 |
| 2,243,275 | 5/1941 | Ewan | 401/40 |
| 2,902,978 | 9/1959 | Legnani | 401/4 |
| 3,613,696 | 10/1971 | Paule | 132/75 |
| 4,592,376 | 6/1986 | Sigmund et al. | 132/112 |
| 4,858,785 | 8/1989 | Wilkinson | 222/145 |
| 4,927,282 | 5/1990 | Morane et al. | 401/4 |
| 4,966,175 | 10/1990 | Kimura et al. | 132/112 |
| 5,568,988 | 10/1996 | Knox et al. | 401/40 |
| 5,762,077 | 6/1998 | Griffiths, Jr. | 132/74.5 |

*Primary Examiner*—John J. Wilson
*Assistant Examiner*—Trang Doan

[57] ABSTRACT

A hair coloring system is provided including a first chamber for containing a first liquid therein. The first chamber includes an outboard face with a brush mounted thereon and an inboard face with a piercing tip. Also included is a second chamber for containing a second liquid. The second chamber includes an outboard face having a membrane secured therein for being pierced upon the engagement of the first chamber and the second chamber. This allows the mixing of the liquids and dispensing thereof via the brush.

8 Claims, 2 Drawing Sheets

HAIR COLORING APPLICATOR WITH MIXING CHAMBER

BACKGROUND OF THE INVENTION

1. Field of the Invention

The present invention relates to hair coloring devices and more particularly pertains to a new hair coloring applicator with mixing chamber for mixing and applying hair coloring to hair of a user.

2. Description of the Prior Art

The use of hair coloring devices is known in the prior art. More specifically, hair coloring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair coloring devices include U.S. Pat. No. 4,341,231; U.S. Pat. No. 5,520,642; U.S. Pat. No. 4,858,785; U.S. Pat. Des. 314,280; U.S. Pat. No. 2,669,740; and U.S. Pat. No. 3,241,722 which are each incorporated herein by reference.

In these respects, the hair coloring applicator with mixing chamber according to the present invention substantially departs from the conventional concepts and designs of the prior art, and in so doing provides an apparatus primarily developed for the purpose of mixing and applying hair coloring to hair of a user.

SUMMARY OF THE INVENTION

In view of the foregoing disadvantages inherent in the known types of hair coloring devices now present in the prior art, the present invention provides a new hair coloring applicator with mixing chamber construction wherein the same can be utilized for mixing and applying hair coloring to hair of a user.

The general purpose of the present invention, which will be described subsequently in greater detail, is to provide a new hair coloring applicator with mixing chamber apparatus and method which has many of the advantages of the hair coloring devices mentioned heretofore and many novel features that result in a new hair coloring applicator with mixing chamber which is not anticipated, rendered obvious, suggested, or even implied by any of the prior art hair coloring devices, either alone or in any combination thereof.

To attain this, the present invention generally comprises a first chamber for containing liquid peroxide therein. Such first chamber is constructed from a flexible, resilient material. As shown in FIGS. 1 & 2, the first chamber includes an intermediate side wall having a cylindrical configuration and an outboard face with a circular opening formed therein. For reasons that will soon become apparent, a peripheral recess is formed about the outboard face with an annular detent extending therefrom. Fixed within the circular opening of the outboard face of the first chamber is a plurality of bundled bristles. The first chamber is further equipped with an inboard portion having a frusto-conical configuration. Such inboard portion has an open inboard end and an annular detent formed thereon adjacent to and spaced from the side wall. Associated therewith is a second chamber for containing liquid hair coloring. The second chamber includes an intermediate side wall having a closed hemispherical inboard face and an open outboard face. Such outboard face includes an inwardly extending annular peripheral lip formed thereon for releasably engaging the annular detent formed in the inboard portion of the first chamber. As shown in FIG. 3, a membrane is formed within the intermediate side wall of the second chamber adjacent to the open outboard end thereof. In use, the membrane is adapted for being punctured upon the engagement of the first chamber with the second chamber. This allows the mixing of the liquid peroxide and the liquid hair coloring. Finally, a ball bearing is situated within the second chamber for facilitating the mixing. Also included is an outboard cap for protecting the bristles. Ideally, the outboard cap is constructed from a transparent material and includes a hemispherical outboard extent and cylindrical inboard extent. The inboard extent is equipped with an open inboard end having an inwardly extending annular peripheral lip. Such peripheral lip of the outboard cap is adapted for engaging the annular detent of the outboard face of the first chamber. Finally, an inboard cap is adapted for preventing the removal of the liquid peroxide from the first chamber. To accomplish this, the inboard cap includes a cylinder with a closed inboard face and an open outboard face. An inwardly extending annular peripheral lip is formed on the outboard face of the inboard cap for releasably engaging the annular detent formed in the inboard portion of the first chamber. As shown in FIGS. 1 & 2, a frusto-conical protrusion is coupled to the outboard face and extends within the cylinder in coaxial relationship therewith. The protrusion thus serves for plugging the open inboard end of the first chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair coloring applicator with mixing chamber apparatus and method which has many of the advantages of the hair coloring devices mentioned heretofore and many novel features that result in a new hair coloring applicator with mixing chamber which is not anticipated, rendered obvious, suggested, or even implied by any of the prior art hair coloring devices, either alone or in any combination thereof.

It is another object of the present invention to provide a new hair coloring applicator with mixing chamber which may be easily and efficiently manufactured and marketed.

It is a further object of the present invention to provide a new hair coloring applicator with mixing chamber which is of a durable and reliable construction.

An even further object of the present invention is to provide a new hair coloring applicator with mixing chamber which is susceptible of a low cost of manufacture with regard to both materials and labor, and which accordingly is then susceptible of low prices of sale to the consuming public, thereby making such hair coloring applicator with mixing chamber economically available to the buying public.

Still yet another object of the present invention is to provide a new hair coloring applicator with mixing chamber which provides in the apparatuses and methods of the prior art some of the advantages thereof, while simultaneously overcoming some of the disadvantages normally associated therewith.

Still another object of the present invention is to provide a new hair coloring applicator with mixing chamber for mixing and applying hair coloring to hair of a user.

Even still another object of the present invention is to provide a new hair coloring applicator with mixing chamber that includes a first chamber for containing a first liquid therein. The first chamber includes an outboard face with a brush mounted thereon and an inboard face with a piercing tip. Also included is a second chamber for containing a second liquid. The second chamber includes an outboard face having a membrane secured therein for being pierced upon the engagement of the first chamber and the second chamber. This allows the mixing of the liquids and dispensing thereof via the brush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
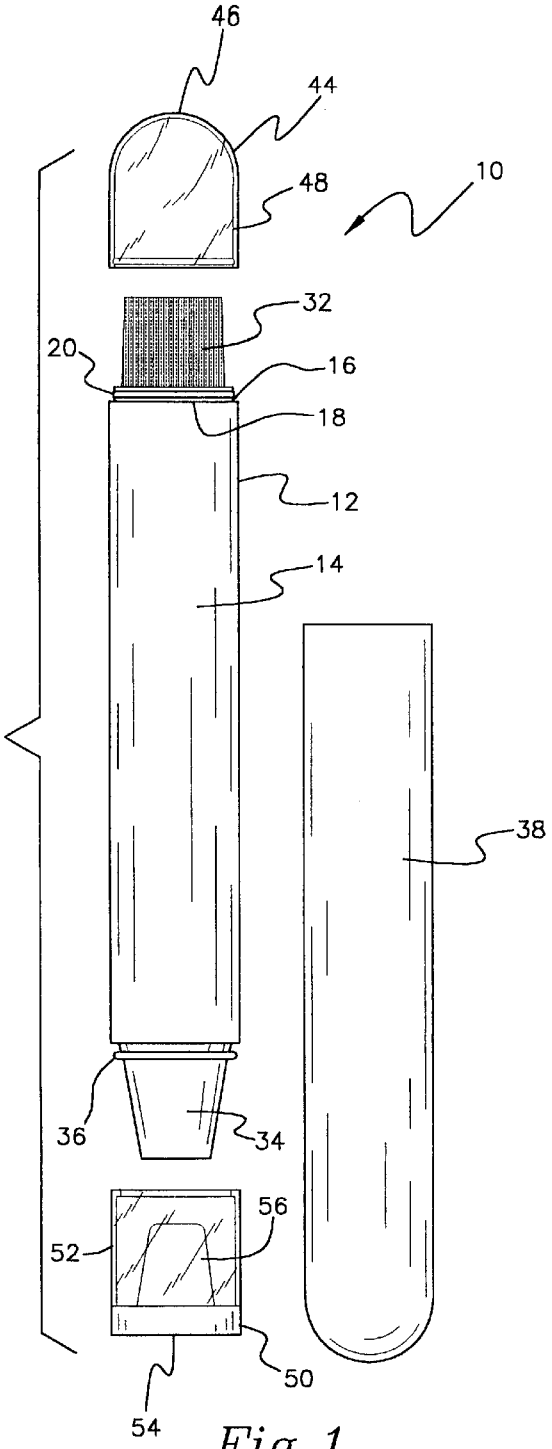
FIG. 1 is an exploded view of a new hair coloring applicator with mixing chamber according to the present invention.

With reference now to the drawings, and in particular to FIGS. 1 through 4 thereof, a new hair coloring applicator with mixing chamber embodying the principles and concepts of the present invention and generally designated by the reference numeral 10 will be described.

Figure 2:
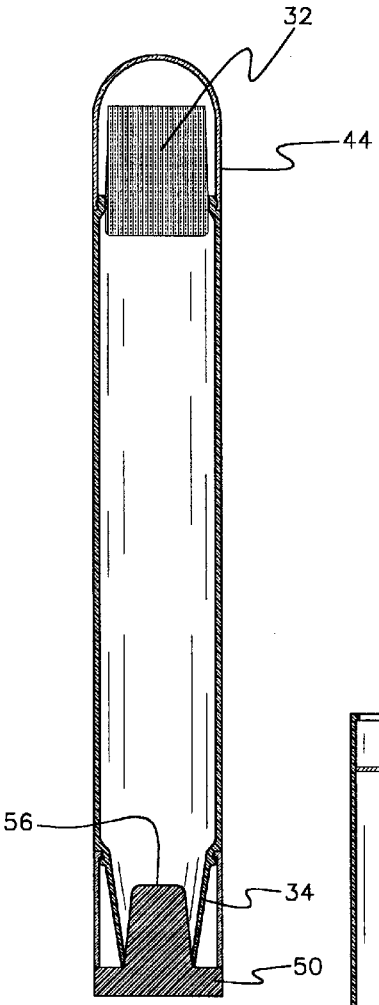
FIG. 2 is a cross-sectional view of the first chamber of the present invention.

The present invention, designated as numeral 10, includes a first chamber 12 for containing liquid peroxide developing lotion therein. Such first chamber is constructed from a flexible, resilient material. As shown in FIGS. 1 & 2, the first chamber includes an intermediate side wall 14 having a cylindrical configuration and an outboard face 16 with a circular opening formed therein. For reasons that will soon become apparent, a peripheral recess 18 is formed about the outboard face with an annular detent 20 extending therefrom. Fixed within the circular opening of the outboard face of the first chamber is a plurality of bundled bristles 32. Ideally, semicircular recesses are formed in the circular opening for facilitating the excretion of liquid from the brush. It should be noted other types of structures may be employed to facilitated excretion like those employed in the ball point pen arts.

The first chamber is further equipped with an inboard portion 34 having a frusto-conical configuration. Such inboard portion has an open inboard end and an annular detent 36 formed thereon adjacent to and spaced from the side wall. Preferably, the open inboard end has a diameter that is more than ½ that of the intermediate side wall of the first chamber. As an option, the open inboard end may be equipped with a manually removed membrane for sealing the same.

Figure 3:
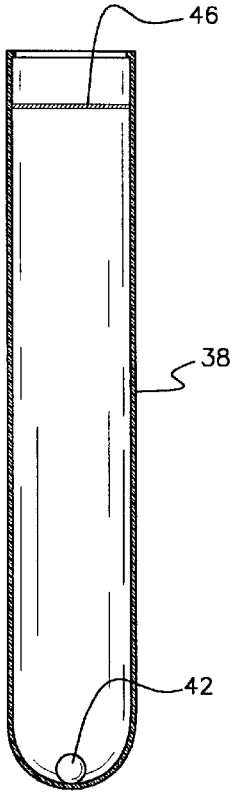
FIG. 3 is a cross-sectional view of the second chamber of the present invention.
Figure 4:
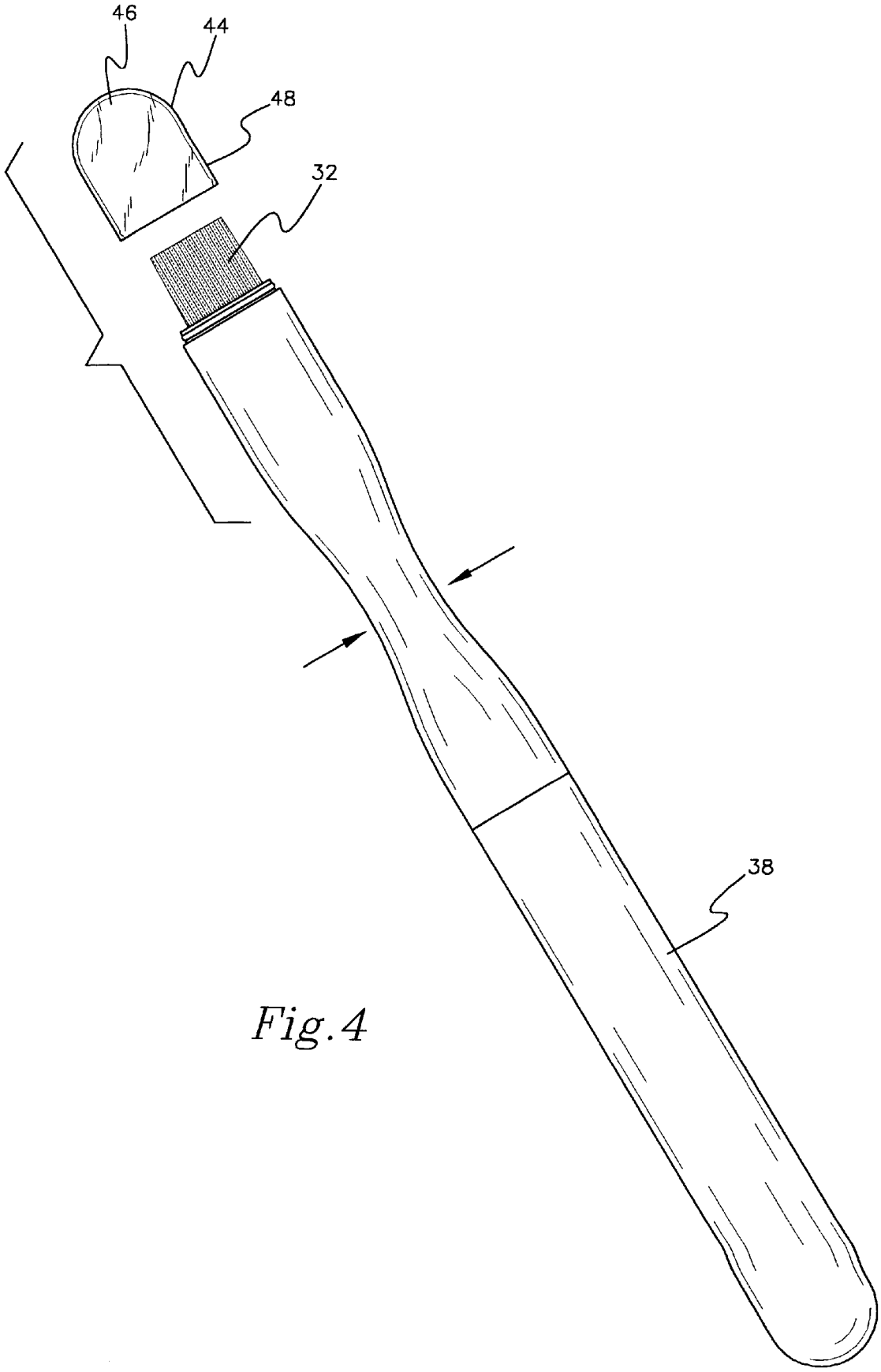
FIG. 4 is an exploded view of the present invention with the first chamber and the second chamber in engagement and the outboard cap removed.

Associated therewith is a compressible second chamber 38 for containing liquid hair coloring in the form of a coloring agent such as a tint or toner. It should be noted that the liquids of the first and second chambers may include any type of liquid known in the art of hair coloring and the like. The second chamber includes an intermediate side wall having a closed hemispherical inboard face and an open outboard face. Ideally, the intermediate side wall of the second chamber has dimensions similar to that of the first chamber. The outboard face of the second chamber includes an inwardly extending annular peripheral lip formed thereon for releasably engaging the annular detent formed in the inboard portion of the first chamber. As shown in FIG. 3, a membrane 40 is formed within the intermediate side wall of the second chamber adjacent to and spaced from the open outboard end thereof.

In use, the membrane is adapted for being punctured upon the engagement of the first chamber with the second chamber. This allows the mixing of the liquid peroxide and the liquid hair coloring. Finally, a ball bearing 42 is situated within the second chamber for facilitating the mixing.

Also included is an outboard cap 44 for protecting the bristles. Ideally, the outboard cap is constructed from a transparent material and includes a hemispherical outboard extent 46 and cylindrical inboard extent 48. The inboard extent is equipped with an open inboard end having an inwardly extending annular peripheral lip. Such peripheral lip of the outboard cap is adapted for engaging the annular detent of the outboard face of the first chamber.

Finally, an inboard cap 50 is adapted for preventing the removal of the liquid peroxide from the first chamber. To accomplish this, the inboard cap includes a cylinder 52 with a closed inboard face 54 and an open outboard face. An inwardly extending annular peripheral lip is formed on the outboard face of the inboard cap for releasably engaging the annular detent formed in the inboard portion of the first chamber. As shown in FIGS. 1 & 2, a frusto-conical protrusion 56 is coupled to the outboard face and extends within the cylinder in coaxial relationship therewith.

During operation, the protrusion serves for plugging the open inboard end of the first chamber. Further, if the inboard end of the first chamber is equipped with a membrane, the protrusion may function to pierce the same. It should be noted that the inboard cap and the second chamber may be fitted on the first chamber one at a time or in the alternative, may be dimensioned to allow the coupling thereof to the first chamber simultaneously.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair coloring system comprising, in combination:

a first chamber for containing liquid peroxide therein constructed from a flexible, resilient material, the first chamber including an intermediate side wall having a cylindrical configuration, an outboard face with a circular opening formed therein and a peripheral recess formed thereabout with an annular detent, a plurality of bundled bristles fixed within the circular opening of the outboard face of the first chamber, and an inboard portion with a frusto-conical configuration having an open inboard end and an annular detent formed thereon adjacent to and spaced from the side wall;

a second chamber for containing liquid hair coloring, the second chamber including an intermediate side wall having a closed hemispherical inboard face, an open outboard face having an inwardly extending annular peripheral lip formed thereon for releasably engaging the annular detent formed in the inboard portion of the first chamber, a membrane formed within the intermediate side wall of the second chamber adjacent to the open outboard end thereof for being punctured upon the engagement of the first chamber with the second chamber thereby allowing the mixing of the liquid peroxide and the liquid hair coloring, and a ball bearing situated within the second chamber for facilitating the mixing;

an outboard cap for protecting the bristles constructed from a transparent material and including a hemispherical outboard extent and cylindrical inboard extent with an open inboard end having an inwardly extending annular peripheral lip for engaging the annular detent of the outboard face of the first chamber; and an inboard cap for preventing the removal of the liquid peroxide from the first chamber, the inboard cap including a cylinder with a closed inboard face, an open outboard face with an inwardly extending annular peripheral lip for releasably engaging the annular detent formed in the inboard portion of the first chamber, and a frusto-conical protrusion coupled to the outboard face and extending within the cylinder in coaxial relationship therewith for plugging the open inboard end of the first chamber.

2. A hair coloring system comprising:

a first chamber for containing a first liquid therein, the first chamber including an outboard face with a brush mounted thereon and an inboard face with a piercing tip fixedly mounted thereon and having an opening on an end thereof, wherein the piercing tip has a substantially frusto-conical configuration; and a second chamber for containing a second liquid, the second chamber including an outboard face having a membrane secured therein for being pierced upon the engagement of the piercing tip of the first chamber and the outboard face of the second chamber, thereby allowing the mixing of the liquids and dispensing thereof via the brush;

wherein the first chamber and the second chamber are releasably engaged via an annular detent/indent combination.

3. A hair coloring system as set forth in claim 2 and further including a transparent cap for protecting the brush.

4. A hair coloring system as set forth in claim 2 and further including a cap with a plug mounted thereon for sealing the inboard face of the first chamber.

5. A hair coloring system as set forth in claim 2 wherein the liquids include hair coloring and peroxide.

6. A hair coloring system as set forth in claim 2 wherein the chambers define an elongated tube when engaged.

7. A hair coloring system as set forth in claim 2 wherein at least one of the chambers is constructed from a flexible, resilient material.

8. A hair coloring system as set forth in claim 2 and further including a ball situated within at least one of the chambers for facilitating the mixing.

* * * * *